US008579338B1

(12) United States Patent
Shah

(10) Patent No.: US 8,579,338 B1
(45) Date of Patent: Nov. 12, 2013

(54) SLIDE BOLT LOCK

(76) Inventor: Kirti Shah, South Barrington, IL (US)

( * ) Notice: Subject to any disclaimer, the term of this patent is extended or adjusted under 35 U.S.C. 154(b) by 397 days.

(21) Appl. No.: 12/839,062

(22) Filed: Jul. 19, 2010

(51) Int. Cl.
*E05C 1/04* (2006.01)
*E05C 1/00* (2006.01)
*E05C 1/06* (2006.01)

(52) U.S. Cl.
USPC ..... 292/145; 292/1.5; 292/137

(58) Field of Classification Search
CPC ..... E05B 65/006; E05B 63/06; E05B 83/30; E05B 27/00; E05B 13/004
USPC ..... 292/1.5, 137, 138, 163, 169, 173, 174, 292/175, 140, 143, 145, 302, 148, DIG. 53, 292/DIG. 54, DIG. 64, 347, 348, DIG. 60, 292/DIG. 68, 1; 70/356, 210, 224, 176, 179, 70/18
See application file for complete search history.

(56) References Cited

U.S. PATENT DOCUMENTS

| | | | | | |
|---|---|---|---|---|---|
| 123,657 | A | * | 2/1872 | Young | 292/175 |
| 410,934 | A | * | 9/1889 | Sanders | 292/175 |
| 513,805 | A | * | 1/1894 | Mann | 292/175 |
| 853,764 | A | * | 5/1907 | Brown | 292/175 |
| 952,715 | A | * | 3/1910 | Shonka | 292/128 |
| 966,780 | A | * | 8/1910 | Thomas | 292/175 |
| 1,205,061 | A | * | 11/1916 | Thull | 292/175 |
| 1,387,643 | A | * | 8/1921 | Erickson et al. | 292/334 |
| 1,442,976 | A | * | 1/1923 | Schendel | 292/175 |
| 1,521,572 | A | * | 12/1924 | Hammer et al. | 292/175 |
| 1,578,598 | A | * | 3/1926 | Gidney | 292/175 |
| 1,625,145 | A | * | 4/1927 | O'Connor | 292/188 |
| 1,720,593 | A | * | 7/1929 | Geiser | 292/175 |
| 1,724,116 | A | * | 8/1929 | Swearengin | 292/175 |
| 1,786,521 | A | * | 12/1930 | Dermody | 292/150 |
| 1,858,608 | A | * | 5/1932 | Wilson | 292/169.21 |
| 1,885,186 | A | * | 11/1932 | Defoy | 292/175 |
| 2,021,803 | A | * | 11/1935 | Nicols | 292/302 |
| 2,087,829 | A | * | 7/1937 | Wraae | 292/164 |
| 2,230,599 | A | * | 2/1941 | O'Connor | 292/19 |
| 2,518,207 | A | * | 8/1950 | Wagner | 292/175 |
| 2,759,752 | A | * | 8/1956 | Demings | 292/337 |
| 3,347,581 | A | * | 10/1967 | Hann | 292/147 |
| 3,955,387 | A | * | 5/1976 | Best et al. | 70/224 |
| 3,955,837 | A | * | 5/1976 | Christensen | 292/173 |
| 4,052,868 | A | * | 10/1977 | Best et al. | 70/224 |
| 4,167,281 | A | * | 9/1979 | Spencer | 292/216 |
| 4,315,648 | A | * | 2/1982 | Labelle | 292/150 |
| 6,938,376 | B2 | * | 9/2005 | Youssef | 49/394 |
| 7,172,222 | B1 | * | 2/2007 | Hotovy | 292/57 |
| 7,290,415 | B2 | | 11/2007 | Rosenberg | |
| 7,562,546 | B2 | | 7/2009 | Taylor | |
| 2007/0284891 | A1 | * | 12/2007 | Polowinczak et al. | 292/175 |
| 2010/0026016 | A1 | | 2/2010 | Tejszerski | |

OTHER PUBLICATIONS

Ceco Door Data Manual.

* cited by examiner

*Primary Examiner* — Carlos Lugo
*Assistant Examiner* — Nathan Cumar
(74) *Attorney, Agent, or Firm* — Patnaude & Videbeck

(57) ABSTRACT

An improved slide bolt locking mechanism is capable of selectably releaseably fastening both overhead doors and swing doors to its surrounding door frame. A portion of the traditional slide bolt is replaced by a lighter actuating mechanism outwardly of the door-transom interface and a form fitting handle. The handle includes an alignable eye assembly capable of securement by a pad or combination lock.

8 Claims, 4 Drawing Sheets

SLIDE BOLT LOCK

This invention relates to a door fastening or latch assembly and, more particularly, to a selectably releasable slide bolt locking mechanism.

BACKGROUND OF THE INVENTION

Door latches and locking mechanisms have long been utilized to releasably secure such doors to their surrounding door frames. Slide bolt type latches are utilized for securing both overhead doors and swinging doors.

Another feature which may be added to slide bolt latches or locking mechanisms for gates or doors, such as barracks or school lockers, includes a hasp-type locking system configured to accommodate a padlock, combination lock, or the like.

Once such existing combination of a tenon-type slide bolt with a hasp-type locking capability is found in a slide bolt latch number 1534 made by CECO Door Company. Slide bolt lock mechanisms are also utilized in connection with overhead door assemblies such as garage doors.

A need has developed for an improved slide bolt latch having hasp latch locking capabilities. It is therefore an object of the invention, generally stated, to provide a new and improved slide bolt lock with hasp padlock receiving capabilities.

Another object of the present invention is the provision of a mortise tenon-type slide bolt lock which may be biased in an opened or closed position.

SUMMARY OF THE INVENTION

A slide bolt latch assembly for selectably releasably securing a door to a door frame comprising a bolt positioned for reciprocal movement between an extended position and a retracted position. A handle is mounted in spaced relation to the bolt positioned for reciprocal movement parallel to it. A connector member is positioned perpendicularly to and between the bolt and the handle. The connector member is securely mounted on the handle and is slidably mounted to the bolt for providing adjustability depending upon the thickness of any door on which the latch assembly is mounted.

BRIEF DESCRIPTION OF THE DRAWINGS

The features of the present invention which are believed to be novel are set forth with particularity in the appended claims. The invention may best be understood from the following detailed description of a currently preferred embodiment and modifications thereof taken in conjunction with the accompanying drawings wherein like numerals refer to like parts and in which:

GENERAL DESCRIPTION OF THE PREFERRED EMBODIMENT

Figure 1:
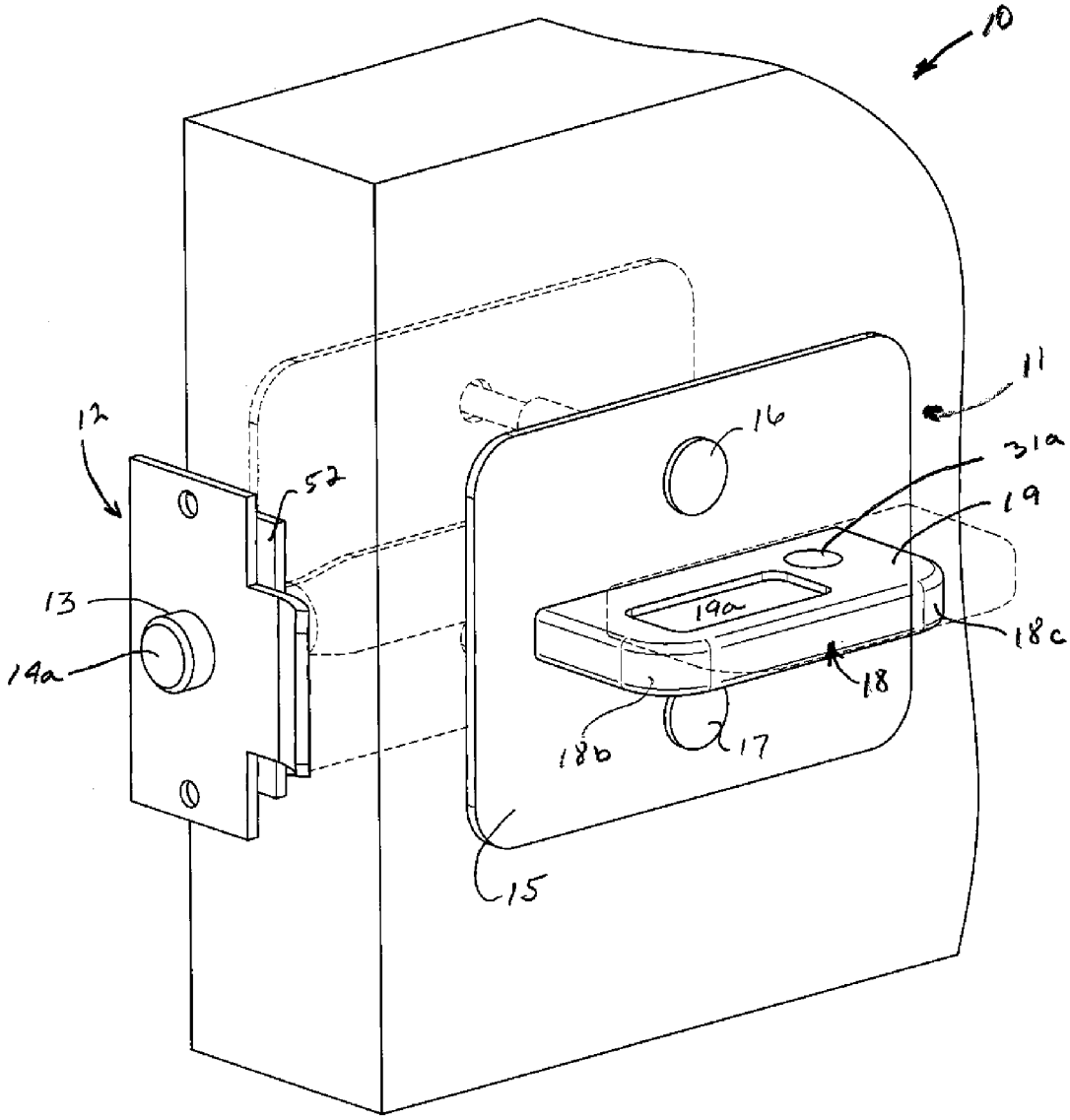
FIG. 1 is a perspective view of a door fragment having a mortise-tenon slide bolt latch constructed in accordance with the invention mounted thereon including a mortise plate mountable on a door frame (not shown) with a bolt receiving aperture thereon.

Referring to FIG. 1, a fragmentary view of a solid door, generally indicated at 10, includes a mortise-tenon type slide bolt latch, generally indicated at 11, which is an improved latch mechanism constructed in accordance with the present invention. Additionally, the latch 11 is shown in connection with its mating mortise strike plate, generally indicated at 12, which is generally mounted on the door frame (not shown) surrounding the door 10. Strike plate 12 includes a hollow collar-like structure 13 which receives the distal end 14*a* of a bolt 14, shown more clearly in FIGS. 5 and 6.

As seen from the outside of the door 10, the latch or lock 11 includes a flat generally rectangular front or exterior cover plate 15 that is retained on the exterior surface of door 10 by a pair of hollow tubular interiorly threaded flat head bolts 16, 17. The only other part of the slide lock which is accessible from the exterior of door 10 is the horizontally slidable handle, generally indicated at 18, which acts as an actuator through linkage, to be discussed in more detail below, for the slide bolt 14 for retracting and extending it. The preferred material for the mechanism is stainless steel, although other metals, protected from rusting, and composite materials may be used within the scope of the invention.

Handle 18 is generally thin, elongated, rectangular in shape with a pair of rounded outside corners 18*b*, 18*c* and a top 19 slightly recessed at 19*b* for ease of gripping by a user.

Figure 2:
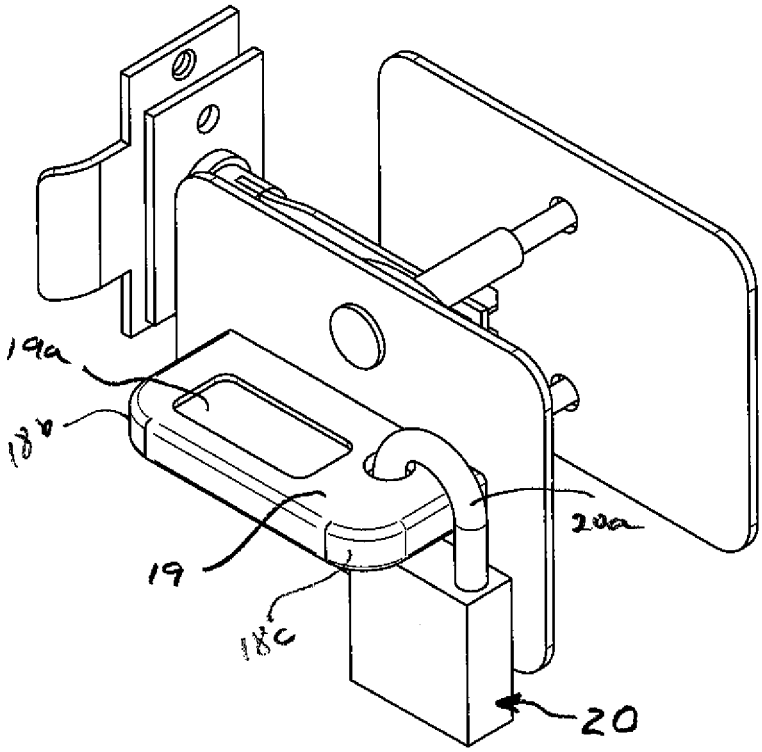
FIG. 2 is a detailed perspective view of the slide bolt latch of the invention as shown in FIG. 1 with the door removed showing the internals of the assembly and with a padlock positioned through the latch mechanism.
Figure 3:
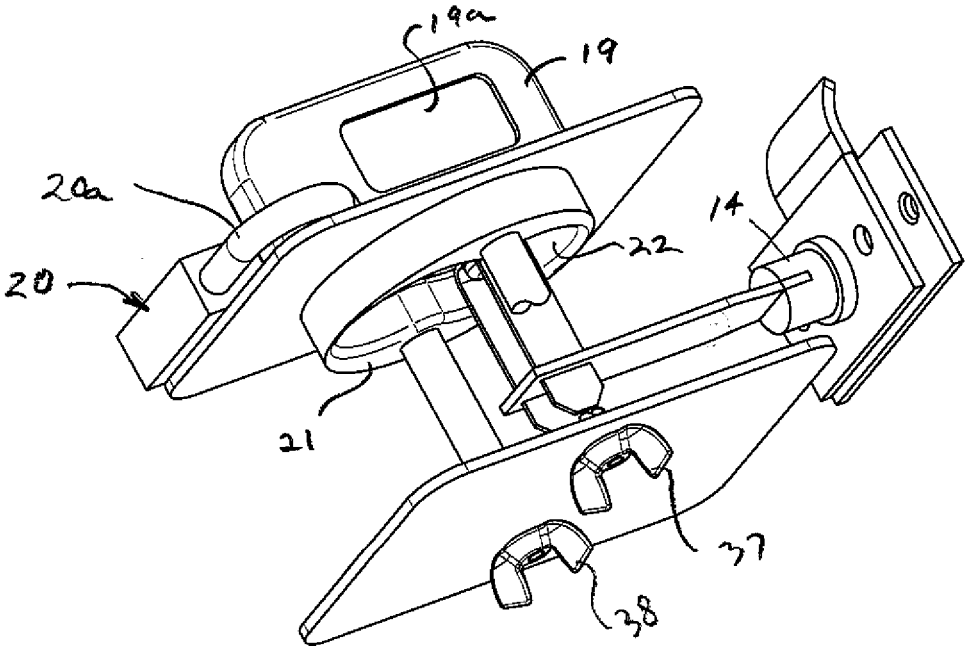
FIG. 3 is a top perspective view of the slide bolt latch mechanism with hasp-type lock and including a first modification thereof.
Figure 4:
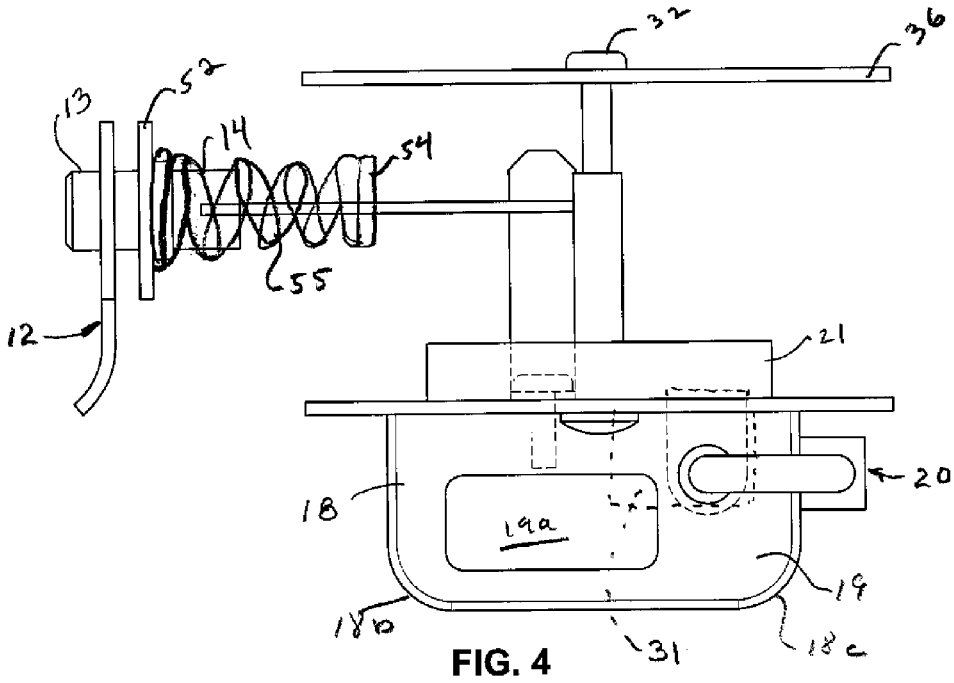
FIG. 4 is a detailed top plan view of the slide bolt lock mechanism of the invention as generally shown in FIGS. 1-3 and including a second modification thereof.

Referring to FIGS. 2, 3 and 4, the assembled slide bolt latch 11 is shown as it would appear with the door 10 removed, and also with a padlock 20 in place with its shackle 20*a* locking the tenon 14 in a closed position inserted in the hollow tubular mortise 13 of scratch plate 12.

As seen most clearly in FIGS. 3 and 4, the exterior or front plate 15 has a generally hollow cylindrical frame securely attached to and extending from the back or interim side of plate 15. Hollow cylindrical frame 21 has a cylindrical outline sized to complementarily fit in a relief hole (not shown) cut in the door (not shown) to provide a solid mounting for the latch mechanism 11 of the invention.

Figure 6:
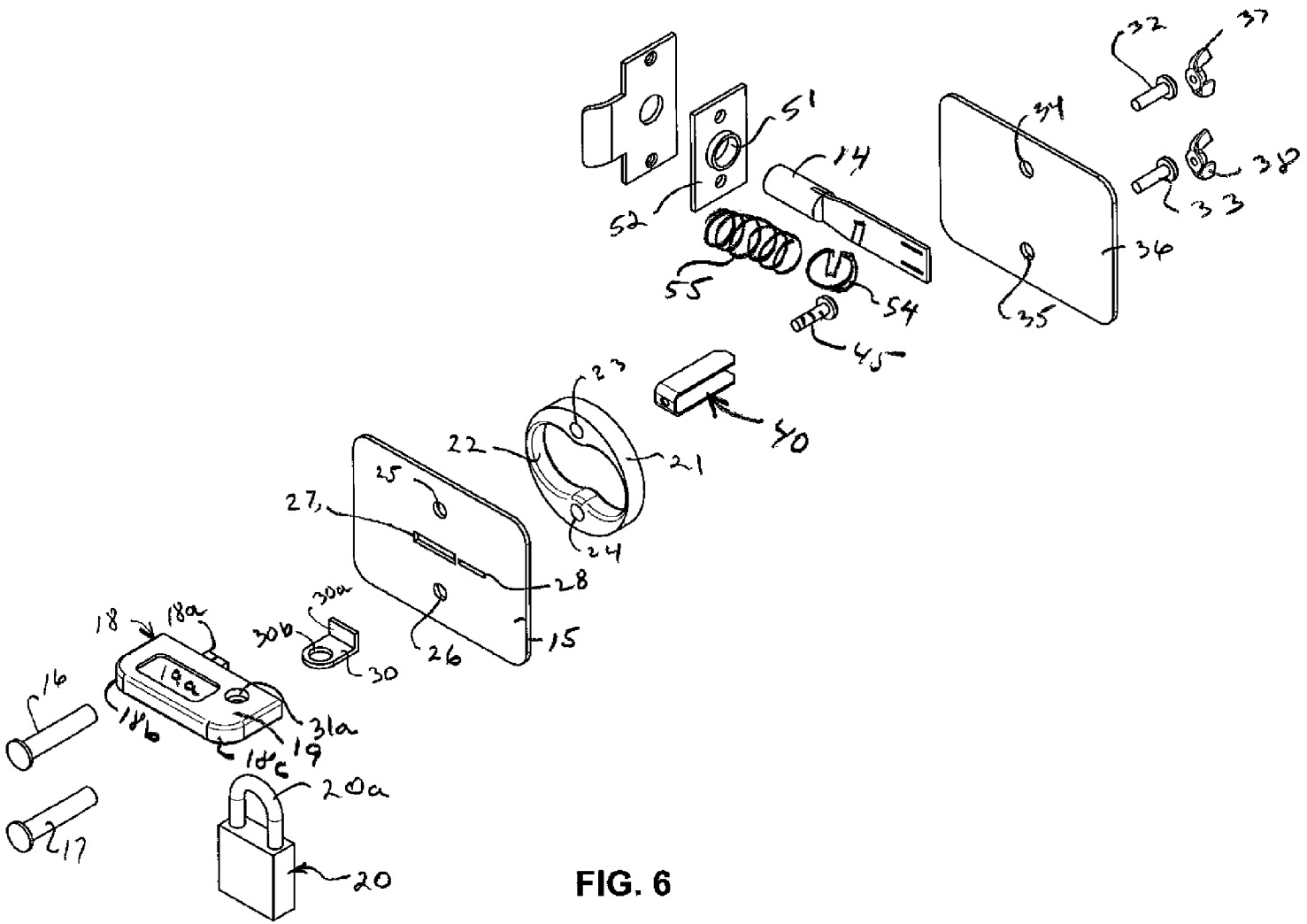
FIG. 6 is an exploded perspective view of the entire slide bolt latch of the present invention.

As shown in FIGS. 3 and 6, the cylindrical frame 21 includes a kidney shaped hollow interior 22 and a pair of vertically oriented horizontally extending bores 23, 24 therethrough which are aligned with mounting holes 25, 26 in the front plate 15 through which the tubular bolts 16, 17 are mounted and retained.

Front plate 15 further includes a rectangular actuator first aperture 27 centrally positioned between the mounting holes 25 and 26, and in this embodiment an offset rectangular second aperture 28. The first aperture 27 provides a slidable mounting for a rectangular flange or detent 18*a* that extends from the base of slide or handle 18 and the second offset aperture 28 provides a through hole for mounting a half hasp flange 30 which is retained on front plate 28 and is sized to extend into a slot 31 (FIGS. 4-5) in the base of handle 18. Both the distal end of rectangular detent 18*a* and the foot 30*a* of hasp flange mounting 30 extends through their respective front plate apertures 27 and 28 into the kidney shaped hollow interior of the frame 21.

As an additional part of the framework and mounting are a pair of threaded carriage bolts 32, 33 which extend through apertures 34, 35 respectively, in a back or interior cover plate 36.

It should be noted that FIGS. 3 and 6 disclose a first modification of the present invention in that instead of carriage bolts 32 and 33, threaded stud bolts having wing nuts, 37, 38 may be substituted in connection with barracks lockers or the like where pranksters may lock an individual in such a locker. With the first modification of the invention, such a person could manually manipulate the wing nuts 37, 38 to disassemble the lock from the inside and allow escape if necessary. Another such mechanism might provide a bar (not shown) extending from the bolt extension 14*b* through a slot in the back plate.

With the use of carriage bolts 32 and 33 threaded onto tubular interiorly threaded bolts 16 and 17 respectively, the front and rear or exterior and interior plates of the lock mechanism of the invention are securely fastened to the door 10.

Figure 5:
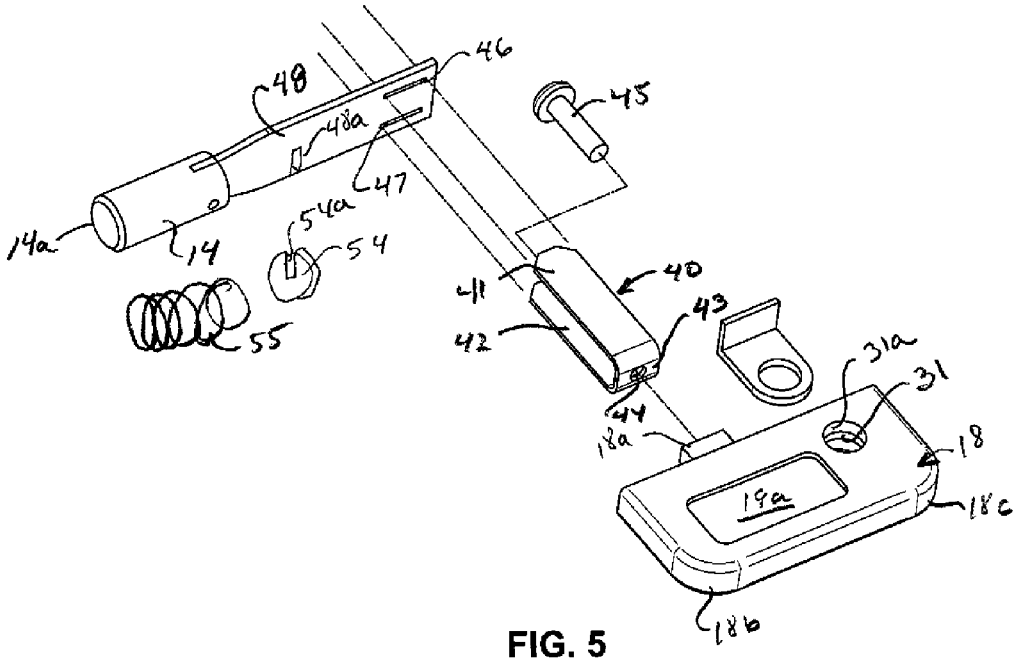
FIG. 5 is an exploded detail fragmentary perspective view of the slide bolt mechanism of the present invention.

With the frame of the slide lock 11 described, the actuator from the handle 18 to the mortise bolt 14 will now be described in further detail. Referring to FIGS. 3, 5 and 6, a U or C shape connector, generally indicated at 40, includes opposed elongate arms 41, 42 and a central bight portion 43 has an aperture 44 positioned centrally therein for receiving a threaded bolt 45 that extends through the bight portion 44 into a threaded bore (not shown) in detent 18*a* in handle 18.

The distal ends 41, 42 of C shaped connector 40 fit into a complementary pair of horizontal slots 46, 47 in a flat elongate extension 50 attached to the rear of the cylindrical mortise bolt 14. The slide bolt 14 extends outwardly of the perimeter of door 10 through an aperture 51 in the lock guide 52.

As shown most clearly in FIGS. 4 and 5, a second modification includes vertical slot 48*a* in the rectangular mortise bolt extension 48 provides a mounting for a slotted disc 54, a combination of slots 54*a* and 48*a* allow the disc 54 to be concentrically mounted on the rectangular extension 48. A coil spring 55 may be positioned between the disc 54 and the mortise guide 52 to bias the mortise bolt in an open position, lengthening the slots 46, 47 and positioning the coil spring between the disc 54 and the C shaped connector distal arms 41, 42 and would bias the mortise bolt 14 in the open position.

Prior slide bolt locks have, in the main, included a heavy one-piece bolt for providing the appearance of strength. The instant improvement provides bulk at the site of the interface between the door and door frame, while substituting lighter actuator structure between the tenon and the handle for ease of actuation and cost savings.

In operation, the handle 18 moves from the forward or closed position shown in solid line in FIG. 1 to that position shown in dotted line. When the handle 18 is moved rearwardly, the U shape connector 40 pulls the rectangular extension 48 of the tenon bolt 14 rearwardly or out of the mortise aperture 13 in strike plate 12. The sliding connection between the distal arms 41, 42 of the U shape connector 40 and the slots 46, 47 respectively in the rectangular extension 48 allow for variances in the thickness of the door 10. The threaded connection between carriage bolts 32, 33 and the tubular interiorly threaded bolts 16 and 17 also allow for variances in the thickness of the door 10.

The vertical mating of the aperture 30*b* of eye shape flange 30 and the aperture 31*a* above and below slot 31 allows the positioning of the shackle 20*a* in padlock 20 to be mounted therethrough when the tenon bolt is extended in its locked position.

While one embodiment of the present invention and two modifications have been shown and described, it will be apparent to those skilled in the art that many changes and modifications may be made without departing from the true spirit and scope of the present invention. It is the intent of the appended claims to cover all such changes and modifications which fall within the true spirit and scope of the invention.

What is claimed:

1. A slide bolt latch assembly for selectably releasably securing a door to a door frame comprising:

a bolt positioned for reciprocal movement between an extended position and a retracted position, a handle in spaced relation to said bolt positioned for reciprocal movement parallel to said bolt, and a connector member positioned perpendicularly to and between said bolt and said handle, said connector member being securely mounted on said handle and slidably mounted to said bolt for providing adjustability depending upon the thickness of a door on which said latch assembly is mounted, said connector member including one of a C and U shape body including a central portion and a pair of parallel spaced arms extending from opposite sides of said central portion.

2. The slide bolt latch as defined in claim 1 wherein said bolt further includes an elongate tab extending therefrom, said tab includes an elongate tab extending therefrom, said tab including a pair of space apart slots therethrough sized to slidably receive said parallel spaced arms of said connector member therethrough.

3. A slide bolt latch assembly for selectably releasably securing a door to a door frame comprising:

a front cover plate including first means for fastening same on the outside of a door, a first horizontal slot centrally positioned through said plate, a rear cover plate including second means for fastening same on the inside of a door, at least one of said front cover plate and said rear cover plate includes a generally cylindrical frame mounted on an interior side thereof, said frame being sized to fit in a relief created in a door on which said latch may be mounted, a bolt positioned for reciprocal movement between an extended position and a retracted position, a handle slidably mounted in said first horizontal slot through said front cover plate, and in spaced relation to said bolt positioned for reciprocal movement in said slot parallel to said bolt, and a connector member which, along with said bolt, is positioned between said front and rear counter plates perpendicularly to and between said bolt and said handle, said connector member being securely mounted on said handle and slidably mounted to said bolt for providing adjustability depending upon the thickness of any door on which said latch assembly is mounted, said connector member including one of a C and U shape body including a central portion and a pair of parallel spaced arms extending from opposite sides of said central portion, an eye detent extending from an exterior side of said front cover plate, and a bore through said handle positioned to align with said eye in said eye detent when said bolt is in its extended position.

4. The slide bolt latch as defined in claim 3 wherein said bolt further includes an elongate tab extending therefrom, said tab includes an elongate tab extending therefrom, said tab including a pair of space apart slots therethrough sized to slidably receive said parallel spaced arms of said connector member therethrough.

5. The slide bolt latch as defined in claim 1 further including:

a front cover plate including first means for fastening same on the outside of a door, and a rear cover plate including second means for fastening same on the inside of a door.

6. The slide bolt latch as defined in claim 5 wherein at least one of said front cover plate and said rear cover plate includes a generally cylindrical frame mounted on an interior side thereof, said frame being sized to fit in a relief created in a door on which said latch may be mounted.

7. The slide bolt latch as defined in claim 6 wherein said front cover includes:

horizontal slot therein on which said handle is reciprocally mounted for moving said bolt, through said connector member, between an open retracted position and a closed extended position.

8. The slide bolt latch as defined in claim 1 wherein said connector member includes:

a mounting at one end thereof for securely mounting same to said handle, and a slot in said bolt through which said connecting member is retained on said bolt for reciprocal movement perpendicularly to the reciprocal movement of said bolt.

* * * * *